US005209475A

United States Patent [19]

Loman

[11] Patent Number: 5,209,475

[45] Date of Patent: May 11, 1993

[54] PUTTER UTILIZING COMPOUND SHAFT AS MOUNTING FOR UPPER SWIVEL HANDLE SUPPORT

[76] Inventor: Ovie Loman, 1394 Yearling Trail, Port Orange, Fla. 32119

[21] Appl. No.: 887,675

[22] Filed: May 18, 1992

[51] Int. Cl.[5] ..... A63B 53/14

[52] U.S. Cl. ..... 273/81 C; 273/194 R; 273/81.2; 273/81 D

[58] Field of Search ..... 273/77 R, 81 R, 81.2–81.6, 273/81 A–81 D, 193 R, 194 R, 193 A, 193 B

[56] References Cited

U.S. PATENT DOCUMENTS

| | | | |
|---|---|---|---|
| 792,631 | 6/1905 | Taylor | 273/81.3 |
| 1,616,377 | 2/1927 | Knight | 273/81.3 |
| 1,919,221 | 7/1933 | James | 273/81.3 |
| 2,445,718 | 7/1948 | Sternberg et al. | 273/81.3 |
| 2,938,728 | 5/1960 | Green | 273/81 D |
| 3,245,686 | 4/1966 | Hartmeister | 273/81.3 |
| 3,263,998 | 8/1966 | Fanning | 273/81.4 |
| 3,529,826 | 9/1970 | Hulyk | 273/81 D |
| 3,995,650 | 12/1976 | DiVito | 273/81 C |
| 4,252,317 | 2/1981 | Vezina | 273/81.2 |
| 4,491,323 | 1/1985 | Kozub | 273/81 D |
| 4,754,978 | 7/1988 | Dworacek | 273/81.3 |
| 4,819,944 | 4/1989 | Doane | 273/81 D |
| 4,869,511 | 9/1989 | Spoonster, Sr. | 273/81 D |
| 4,889,343 | 12/1989 | Nielsen | 273/81 C |
| 5,037,103 | 8/1991 | Williams et al. | 273/81 D |
| 5,088,738 | 2/1992 | Mundt et al. | 273/81 C |

*Primary Examiner*—V. Millin
*Assistant Examiner*—Steven Wong
*Attorney, Agent, or Firm*—Julian C. Renfro

[57] ABSTRACT

A golf club having a head equipped with a compound shaft, such head having a face portion and the compound shaft having lower and upper ends, with the lower end of the compound shaft attached to the club head. The upper end of the compound shaft has dual, spaced-apart upper portions that can be separated only for a limited extent, with a rotatable handle being disposed between the upper portions of the compound shaft. This rotatable handle is disposed parallel to the face portion of the club head, whereby a golfer holding the rotatable handle with one hand in a perpendicular relationship to the golf ball is able to swing with his other hand, the face portion of the head toward the ball in a highly accurate, well-aimed manner. A spring may optionally be utilized for biasing the upper portions together, so that the rotatable handle will be properly supported.

14 Claims, 2 Drawing Sheets

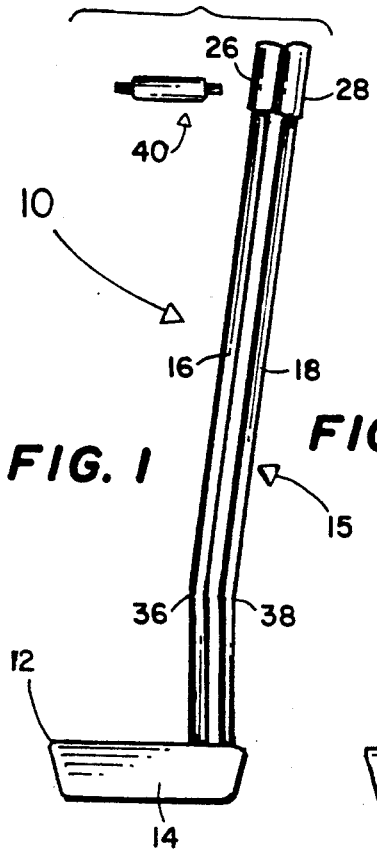
FIG. 1
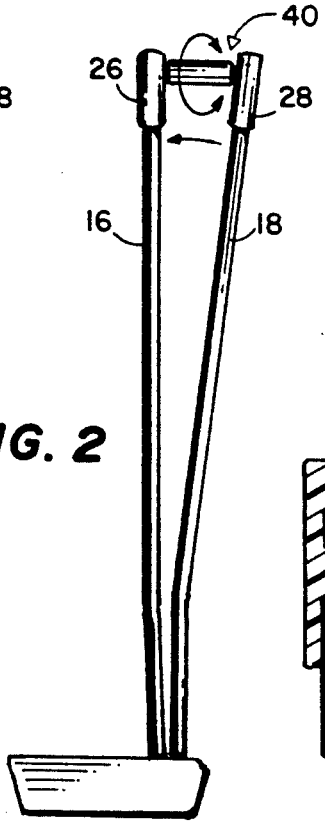
FIG. 2
FIG. 3
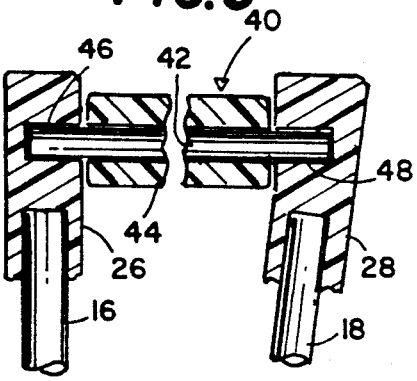
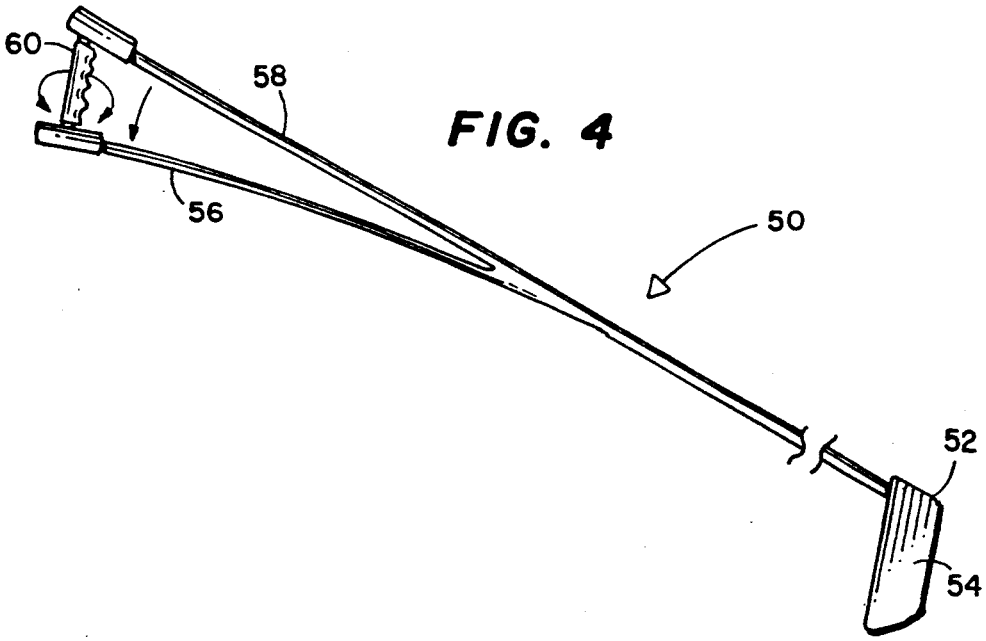
FIG. 4

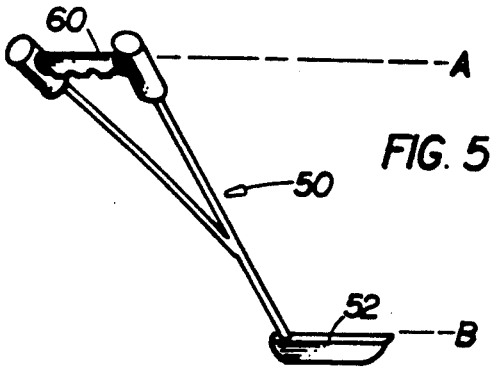
FIG. 5
FIG. 6
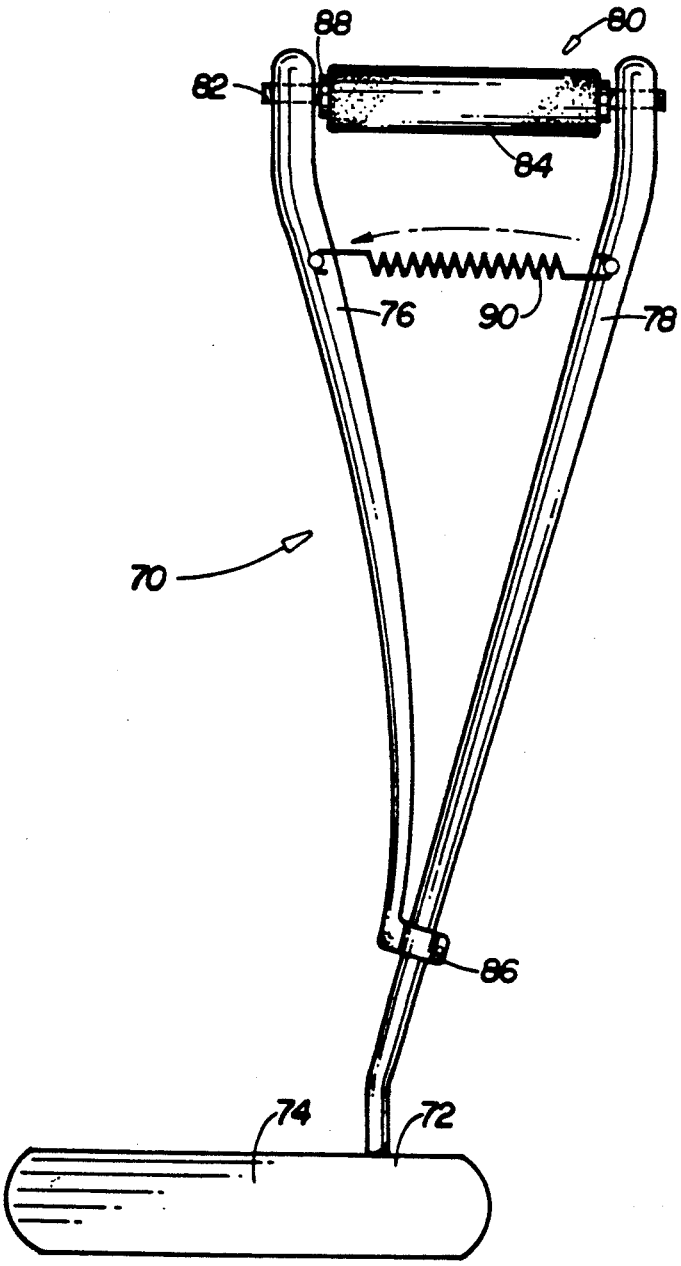
FIG. 7
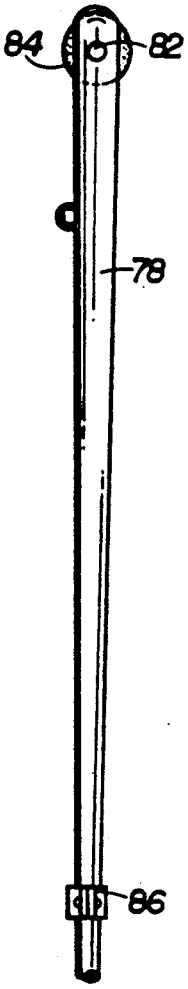

PUTTER UTILIZING COMPOUND SHAFT AS MOUNTING FOR UPPER SWIVEL HANDLE SUPPORT

BACKGROUND OF THE INVENTION

The golf swing is notoriously difficult for a beginner to learn and the average golfer to maintain. The single shafted conventional golf club is grasped with both hands together, one below the other, and can easily be manipulated by pronation and supination (rolling) of the wrists and arms virtually in the same manner as if the club were grasped with either hand alone. The pronation and supination, in the hands of a beginner or average golfer, result in the club face meeting the ball at various angles, causing frequently improperly hit shots. This invention virtually eliminates this uncontrolled motion with the result that the club face remains basically square throughout the swing.

Inasmuch as most club grips are merely round in section, one of the more common problems is the difficulty in properly aligning the club and positioning the hands and fingers on the club to maintain the club face in alignment, in the absence of an index means on the handle. When the club is properly gripped, the wrist must be cocked in a very severe and unnatural position so that the club shaft and the left arm are lying in a parallel relation. This extra strain, which is thrown on the wrist, makes it more difficult to attain a uniform or what is commonly called an "in the groove swing." One tendency, due to this difficulty, is for the player to grip the club too tightly, thus putting the muscles under tension and interfering with control of the direction and speed of the club which he is usually capable of exercising.

The present invention alleviates these problems in providing an improved handle for a putter that enables the club to be swung in the manner of a pendulum, by using a rotatable handle disposed at the upper end of the shaft, disposed in a parallel relation to the face of the club.

I am quite aware that others have provided pendulum type putters, and examples are the Hartmeister U.S. Pat. No. 3,245,686 entitled "Golf Club With T-Shaped Handgrip," and the Kozub U.S. Pat. No. 4,491,323 entitled "Pendulum Putter." Both of these prior art devices have distinct disadvantages, however, with the configuration of the Hartmeister device being such that his club is difficult to insert into a golf bag, and the Kozub patent utilizes an upper support member that is hard for some golfers to grasp in a comfortable and effective manner.

It was to overcome the disadvantages of devices such as these that the present invention was evolved.

SUMMARY OF THE INVENTION

A golf club in accordance with this invention has a head equipped with a compound shaft, with the head having a face portion. The compound shaft has lower and upper ends, with the lower end of the compound shaft attached to a rear portion of the club head, and the upper end of the compound shaft having dual, spaced-apart upper portions. A rotatable handle is secured between the upper portions of the compound shaft in a manner so as to minimize friction, which rotatable handle is disposed, quite significantly, in a parallel relation to the face portion of the club head. As a result of this construction, the golfer, while holding in one hand the rotatable handle in a perpendicular relationship to the golf ball, is able to swing with his other hand, the face portion of the head toward the ball in a highly accurate, well-aimed manner. In a manner of speaking, the club head is swung in a pendulum-like manner about the rotatable handle.

One embodiment of my invention is characterized by the compound shaft involving entirely separate shaft portions secured to the head and extending upwardly to the rotatable handle, whereas another embodiment is characterized by a single shaft portion secured to said head, which single shaft portion divides at a location between the club head and rotatable handle, so as to form separate upper shaft portions.

As will be seen hereinafter, my highly advantageous design enables the golfer to swing the head of the club through an arc, rather than slapping or chopping at the ball. I have found that slapping or chopping at the ball is one of the greatest errors committed during putting, with lack of proper alignment of the club face being the other. My design enables the golfer to avoid both of these problem areas.

A primary object of this invention is thus to provide a putter enabling a golfer to putt with greatly increased accuracy.

Another object of this invention is to provide an improved golf putter which may be used in the manner of a pendulum and including a simplified and highly effective upper handle portion designed to function as the axis of swinging movement of the putter.

Still another important object of this invention is to provide a putter equipped with a wide, low friction handle aligned parallel with the face of the club, which handle can be readily removed at such time as the golfer has completed his or her putting, so that the putter can be readily inserted back into a conventional golf bag.

Yet still another object of this invention is to provide a pendulum type putter which will conform to conventional forms of manufacture, and be of simple construction and easy to use insofar as providing a device that will be economically feasible, long lasting, and relatively trouble free in operation.

Still another object of my invention is to provide a putter utilizing a wide rotatable handle at the top of the shaft, by which the face of the putter can be accurately aligned with the hole.

Yet still another object is to provide a putter equipped with a compound shaft and a rotatable handle supported at the upper end of the shaft, disposed in a parallel relationship to the face of the putter, with the golfer being able to hold the rotatable handle with one hand in a perpendicular relationship to the ball, and by use of the other hand swing the head of the club toward the ball in a well-aimed, highly accurate manner.

These and other objects, features and advantages will be more apparent as the description proceeds.

BRIEF DESCRIPTION OF DRAWINGS

FIG. 1 is a side elevational view of a putter equipped with my novel compound shaft arrangement, this particular embodiment involving two adjacent, entirely separate shaft portions extending upwardly from the club head to upper fixed handle portions;

FIG. 2 is a side elevational view closely resembling FIG. 1, but in this instance showing how the separate shaft portions of the compound shaft have been moved apart so as to accommodate the rotatable handle I utilize;

FIG. 3 is a view to an enlarged scale of the rotatable handle utilized at the uppermost part of my putter, which handle is disposed in a virtually friction free manner at the upper end of the shafts, in a parallel relation to the club face;

FIG. 4 is a side elevational view of an embodiment of my compound shaft arrangement wherein a single shaft portion is secured to the head of the putter, which then divides at approximately a mid point of the length of the shaft to form the spaced-apart upper portions between which the rotatable handle is mounted;

FIG. 5 is a view from above, showing how the rotatable handle utilized at the uppermost portion of the club is disposed in a parallel relation to the face of the club;

FIG. 6 represents a front view of a primary embodiment of my invention wherein the rear shaft portion is affixed to the club head, and the front shaft portion is readily added to the putter at such time as the golfer is ready to use the putter; and FIG. 7 is a side elevational view of the shaft of the club depicted in FIG. 6.

DETAILED DESCRIPTION

With initial reference to FIG. 1 it will be seen that I have illustrated a first embodiment of my putter 10, involving a head 12 configured to have a face or ball-striking surface 14, where contact with the golf ball is to be made.

Extending upwardly from the head 12 is a compound shaft 15, and in the embodiment depicted in FIG. 1, the compound shaft is seen to involve separate shaft portions 16 and 18, residing in an essentially parallel relationship, and being of approximately the same length. The shaft portions 16 and 18 are disposed in the same plane as the club head 12, with the front or forward shaft 16 in this embodiment being located directly in front of the rear shaft 18, with the base portions of both shafts firmly embedded in a rearward portion of the club head 12. As is obvious, when the shafts are in the relation depicted in FIG. 1, the putter can be readily inserted into the golfer's bag. I am not to be limited to any one constructional material, but in the preferred instance I utilize aluminum in the manufacture of the shafts 16 and 18.

The shaft portions 16 and 18 of the compound shaft 15 are of high strength, resilient material, yet are flexible enough to permit the tops of the shafts to be separated into the configuration depicted in FIG. 2, so that the low friction handle member 40 can be inserted between the upper ends of the shafts. After putting has been completed, the golfer springs the upper ends of the shafts apart, removes the rotatable handle member 40. This of course permits the shafts to return to the close together configuration illustrated in FIG. 1, such that the putter can be readily reinserted into the golf bag.

Firmly affixed at the upper end of each shaft portion is a short handle portion, made of wood, plastic or the like, with handle portion 26 being utilized at the top of the shaft 16, and handle portion 28 being utilized at the top of the shaft 18. It is to be noted that the longitudinal centerline of each short handle portion is disposed on the centerline of the respective shaft. The fixed handle portions 26 and 28 thus serve as the mounting means for the rotatably mounted handle 40 depicted in FIGS. 2 and 3, that is to be grasped by the golfer at the time he or she is ready to putt. The rotatable handle 40 is mounted in a carefully aligned manner, such that it will be precisely parallel with the face 14 of the club head.

It will be noted that I may utilize a bend in each shaft at a location relatively near the club head 12, with the bend 36 in the shaft 16 being in a closely disposed relationship to the bend 38 in rear shaft 18. I have found that the bend 38 in the rear shaft 18 is particularly important to the arrangement by which the shafts can be separated to the operational position of the club, which is depicted in FIG. 2.

When the golfer is ready to use the putter, it is expected that he or she will move the upper ends of the compound shaft 15 apart to a sufficient degree that the rotatably mounted handle 40 can be inserted into a low friction, operable position between the short fixed handle portions 26 and 28, in the manner depicted in FIG. 2, and revealed in enlarged detail in FIG. 3.

With further reference to FIG. 3, it is to be understood that the handle 40 has a central axial member 42, typically of steel or some other high strength material, with the axial member extending for a short distance beyond the portion 44 of the handle actually grasped by the golfer. Aligned holes 46 and 48 are provided in the upper handle portions 26 and 28, respectively, into which holes the extending ends of the axial members 42 are disposed. The holes 46 and 48 are "blind" holes, or in other words, do not extend entirely through the members 26 and 28.

In order to minimize rotational friction, I utilize an axial member 42 that is long enough that when the ends of the axial member have bottomed in the holes 46 and 48, the ends of the grasped portion 44 will not be in contact with the inner portions of the fixed upper handle portions 26 and 28.

Turning now to FIG. 4, it is to be seen that in this embodiment, the compound shaft 50 has a unitary portion affixed in the rear portion of the club head 52, with the face 54 to be used in striking the ball being parallel to the rotatable handle portion 60. The unitary shaft portion divides at approximately a mid point of the shaft to form upper portions 56 and 58, that normally reside closely adjacent each other, such that the club can be easily inserted into a conventional golf bag. The upper shaft portions are of high strength, resilient material, such that when forced apart by the golfer, they can receive a handle 60. In one particular instance, aluminum was used in the creation of the compound shaft, but quite obviously I am not to be limited to the use of this material in the fabrication of the putter. The material used in creating the shaft portions must be of such a nature that the upper portions 56 and 58 will quickly return to the closely spaced relationship upon the handle portion 60 being removed.

In FIG. 5 I reveal the putter of FIG. 4 from a different perspective, so as to reveal the important parallel relationship between the rotatable handle 60, which is represented by axis A, and the face of the putter head 52, which is represented by axis B.

Turning to FIG. 6, I there show a primary embodiment of my novel putter, which utilizes a compound shaft 70, that may for example be made of graphite, but to which material I am obviously not limited. FIG. 6 reveals that the rear shaft portion 78 extends all the way from the club head 72, to the location where the rear of the swivel handle 80 is to be mounted in a parallel relationship to the club face 74.

FIG. 6 also reveals that the forward shaft portion 76 is a separate member, having a lower portion 86 in the nature of an interconnection means. At the time the putter is to be used, the golfer can pull the forward shaft portion 76 away from the rear shaft portion 78 for a distance permitting the insertion of the swivel handle 80 in a minimal friction relationship to the upper portions of these shafts. The interconnection means 86 is preferably a component permitting only limited movement, so that when the golfer is moving the forward shaft portion away from the rear shaft portion, he must put forth some effort to move these members far enough apart as to permit the insertion of the swivel handle 80.

As a supplement to the use of an interconnection means 86 permitting only limited movement, I can utilize a tension spring 90 extending between upper locations on the forward shaft portion 76 and the rear shaft portion 78. The purpose of the spring 90 is of course to resist the forward and rear shaft portions moving apart so far as to permit the rotatable handle 80 to move away from its operative position. The spring force is not so great, however, as to inhibit the rotation of the handle at the time the putter is in use.

The use of the tension spring 90 in an instance in which the interconnection means 86 permits only limited movement is optional, but the use of the spring 90 is a necessity when the interconnection means takes the form of an ordinary hinge type device.

Still another arrangement can involve the interconnection means 86 having tightening means thereon and being slidable over the top of rear shaft portion 78, so as to be movable downwardly to a location on the shaft member 78 in which the upper end of forward shaft portion 76 is in careful alignment with the upper end of shaft portion 78. When the upper shaft portions are in alignment, the golfer can tighten the interconnection means 86 and then insert the rotatable handle 80 in a minimal friction relationship with respect to these shaft portions. As previously mentioned, the rotatable handle 80 is precisely parallel with the club face 74. The use of the spring 90 may be highly desirable in this embodiment of my invention.

FIG. 7 is a side or edge view of the putter depicted in FIG. 6, with this view revealing that the rear shaft member 78 can possess a degree of taper.

As is obvious, when the putting has been completed, the handle 80 is removed, so as to permit ready insertion of the club into the golf bag.

I claim:

1. A golf club having a head equipped with a compound shaft, said head having a face portion and said compound shaft having lower and upper ends, with the lower end of said compound shaft attached to said club head, and the upper end of said compound shaft having dual, spaced-apart upper portions that can be separated only for a limited extent, a rotatable handle disposed between said upper portions of said compound shaft, which rotatable handle is disposed parallel to said face portion of said club head, whereby the golfer holding said rotatable handle with one hand in a perpendicular relationship to the golf ball is able to swing with his other hand, the face portion of said head toward the ball in a highly accurate, well-aimed manner.

2. The golf club having a head equipped with a compound shaft as recited in claim 1 in which said compound shaft is characterized by two adjacent, entirely separate shaft portions secured to said head and extending upwardly to said upper portions between which said rotatable handle is rotatably mounted.

3. The golf club having a head equipped with a compound shaft as recited in claim 1 in which said compound shaft is characterized by a single shaft portion secured to said head, which single shaft portion divides at approximately a midpoint of the length of the shaft to form said spaced-apart upper portions between which said rotatable handle is rotatably mounted.

4. The golf club having a head equipped with a compound shaft as recited in claim 1 in which said compound shaft is characterized by a primary shaft and a secondary shaft, with the lower end of said primary shaft being secured to said head, the lower end of said secondary shaft being affixed at a mid portion of said primary shaft, with the upper end of the secondary shaft serving with the upper end of said primary shaft to support said rotatable handle.

5. The golf club having a head equipped with a compound shaft as recited in claim 4 in which the lower end of said secondary shaft is secured to said primary shaft by a hinged connection means permitting only limited rotation of said secondary shaft away from said primary shaft.

6. The golf club having a head equipped with a compound shaft as recited in claim 4 in which the lower end of said secondary shaft is secured to said primary shaft by a connection means having tightening means thereon.

7. The golf club having a head equipped with a compound shaft as recited in claim 4 in which the lower end of said secondary shaft is secured to said primary shaft by a hinged connection means, and a tension spring extending between said primary and secondary shafts, and serving to bias the upper ends of said primary and secondary shafts together, for the proper support of said rotatable handle.

8. A golf club having a head to which a compound shaft is connected, said head having a face portion and said compound shaft being constructed of resilient material having lower and upper portions, with the lower portion of said compound shaft rigidly attached to said club head, and the upper portion of said compound shaft having dual, spaced-apart upper segments, a low-friction, rotatable handle secured between said upper segments of said compound shaft, which rotatable handle is disposed parallel to said face portion of said club head, whereby the golfer holding said rotatable handle with one hand in a perpendicular relationship to the golf ball is able to swing with his other hand, the face portion of said head toward the ball in a highly accurate, well-aimed manner.

9. The golf club having a head connected to a compound shaft as recited in claim 8 in which said compound shaft is characterized by two adjacent, entirely separate shaft portions secured to said head and extending upwardly to said upper segments between which said rotatable handle is rotatably mounted.

10. The golf club having a head connected to a compound shaft as recited in claim 8 in which said compound shaft is characterized by a single shaft portion secured to said head, which single shaft portion divides at approximately a midpoint of the length of the shaft to form said spaced-apart upper segments between which said rotatable handle is rotatably mounted.

11. The golf club having a head connected to a compound shaft as recited in claim 8 in which said compound shaft is characterized by a primary shaft having a mid portion in addition to said upper and lower portions, which primary shaft extends upwardly from said head to an upper location, where it serves as the support for one end of said rotatable handle, said primary shaft being utilized in conjunction with a secondary shaft having upper and lower portions, said lower portion of said secondary shaft being connected to said mid portion of said primary shaft, with the upper portions of said primary and secondary shafts forming said dual, spaced-apart upper segments serving as the minimal friction support for said rotatable handle.

12. The golf club having a compound shaft as recited in claim 11 in which the lower end of said secondary shaft is secured to said primary shaft by a hinged connection means permitting only limited rotation of said secondary shaft away from said primary shaft.

13. The golf club having a compound shaft as recited in claim 11 in which the lower end of said secondary shaft is secured to said primary shaft by a connection means having tightening means thereon.

14. The golf club having a compound shaft as recited in claim 11 in which the lower end of said secondary shaft is secured to said primary shaft by a hinged connection means, and a tension spring extending between said primary and secondary shafts so as to bias the upper portions of said primary and secondary shafts together, for the proper support of said rotatable handle.

* * * * *